US008134059B2

(12) United States Patent
Zink et al.

(10) Patent No.: US 8,134,059 B2
(45) Date of Patent: Mar. 13, 2012

(54) CREDIT CARD GUITAR PICK HOLDER

(76) Inventors: Braxton W. Zink, Brookline, MA (US); Robert D. Burn, Arlington, MA (US)

( * ) Notice: Subject to any disclaimer, the term of this patent is extended or adjusted under 35 U.S.C. 154(b) by 0 days.

(21) Appl. No.: 12/818,393

(22) Filed: Jun. 18, 2010

(65) Prior Publication Data

US 2011/0100192 A1 May 5, 2011

Related U.S. Application Data

(63) Continuation of application No. 12/817,596, filed on Jun. 17, 2010, now abandoned.

(60) Provisional application No. 61/218,153, filed on Jun. 18, 2009.

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS

| | | | | |
|---|---|---|---|---|
| 4,034,210 | A | 7/1977 | Hill et al. | |
| 4,785,708 | A | 11/1988 | Vaughan | |
| 4,890,531 | A | 1/1990 | Tischer | |
| 5,127,300 | A | 7/1992 | Silverman | |
| 5,413,020 | A | 5/1995 | Thompson | |
| 6,215,052 | B1 | 4/2001 | Giddens et al. | |
| 6,703,546 | B1 | 3/2004 | Wilson | |
| 7,703,808 | B2 | 4/2010 | Wilen | |
| 2007/0006713 | A1 * | 1/2007 | Dunlop | 84/322 |
| 2008/0134410 | A1 | 6/2008 | Eisenberg | |

* cited by examiner

*Primary Examiner* — Kimberly Lockett
(74) *Attorney, Agent, or Firm* — Elmore Patent Law Group, PC; Roy P. Issac, Esq.; Carolyn S. Elmore, Esq.

(57) ABSTRACT

The present invention relates to an apparatus for storing and dispensing guitar picks. More particularly, the present invention relates to a credit card shaped housing apparatus that holds and dispenses about 1-5 guitar picks. The credit card guitar pick apparatus is able to be stored in a wallet providing a convenient, quickly available, organized supply of guitar picks to a musician.

10 Claims, 5 Drawing Sheets

CREDIT CARD GUITAR PICK HOLDER

RELATED APPLICATIONS

This application is a continuation of U.S. application Ser. No. 12/817,596, filed Jun. 17, 2010 which claims the benefit of U.S. Provisional Application No. 61/218,153, filed Jun. 18, 2009. The entire teachings of the above applications are incorporated herein by reference.

BACKGROUND OF INVENTION

One popular type of string instrument is the guitar. Most guitar players use guitar picks to play music on the guitar. Guitar picks are thin, flat, egg shaped pieces of plastic or wood which are used to strum the strings of an acoustic or electric guitar during guitar play and are frequently used by beginners of guitar playing, as well as, by experienced players. Typically, guitar picks are packaged in large counter displays, clamshells and/or poly bags with header.

There are several problems associated with storage of guitar picks for playing music on the guitar. One problem is that guitar players typically use many different picks during a musical performance. The guitar player may drop, break or otherwise desire to select a certain pick to play a song. It is desirable for a musician to have an ample supply of picks readily available during musical performance. Typically, the picks are often placed in a guitar case or other container. The picks are often lost or become unorganized in the guitar case or other container. Additionally, the guitar player typically has one or more favorite picks that the musician would like to organize and display when the guitar is not being played.

There have been attempts to solve some of problems associated with the use and storage of guitar picks, however, the prior art focuses on portable guitar pick dispensers which often lack aesthetic appeal, are not configured to securely hold guitar picks and/or require temporary or permanent mounting to a human guitar player, the guitar instrument or its casing. (U.S. Pat. Nos. 6,215,052; 5,127,300; 6,703,546; D 309,674; 4,785,708; 4,890,531; 5,413,020;) They are generally designed as storage spaces on the guitar itself or as standalone devices that are often not suitable for carrying in pocket or in a wallet. As such, a need exists to provide musicians with alternate storage options for their guitar picks.

SUMMARY OF THE INVENTION

Figure 1:
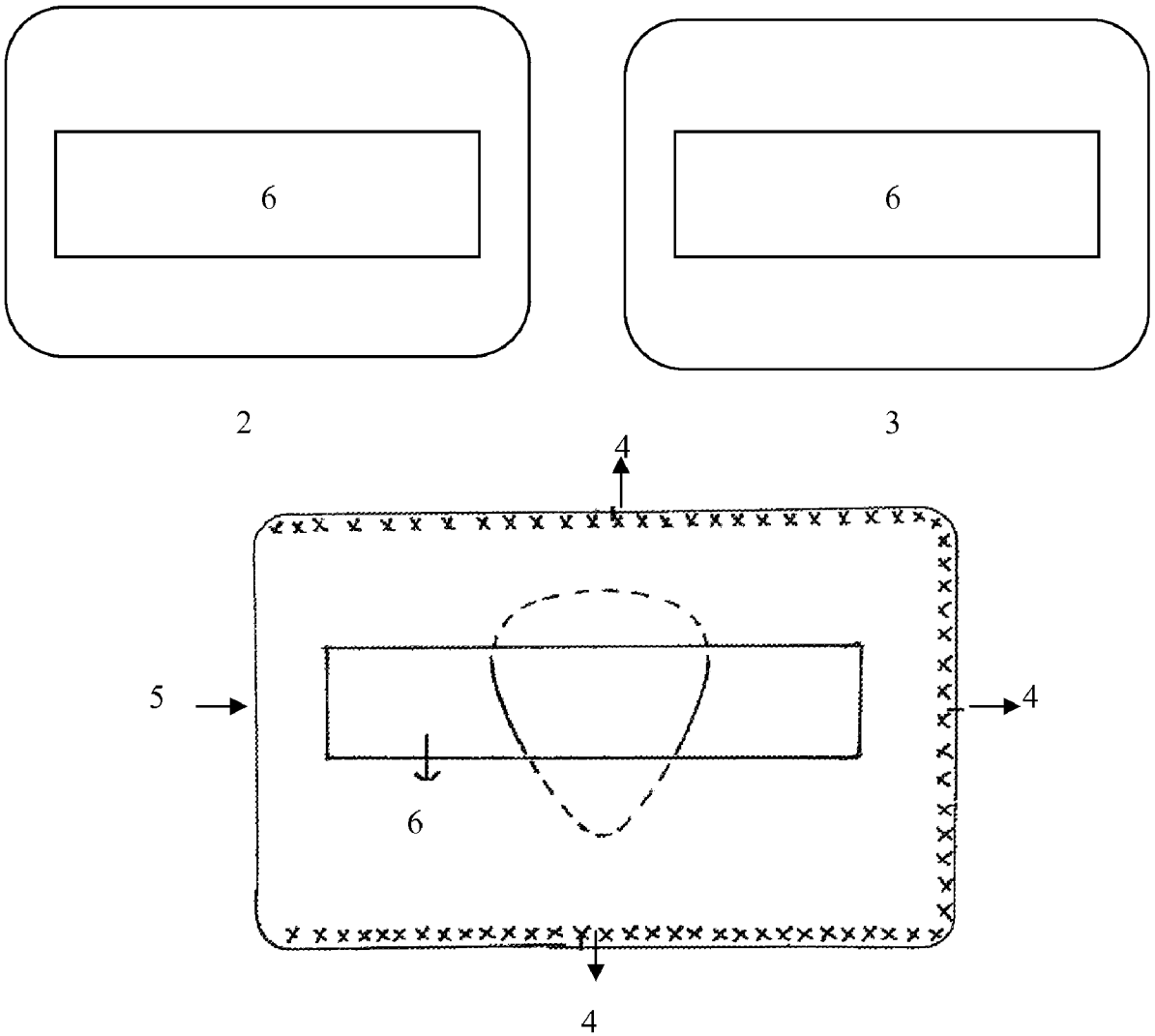
FIG. 1 is a perspective view of one embodiment of the present invention.

The present invention relates to an apparatus for storing and dispensing guitar picks. More particularly, the present invention relates to a credit card shaped housing apparatus that securely holds and dispenses about 1-5 guitar picks. The credit card guitar pick apparatus is able to be stored compactly in a wallet providing musicians a convenient, quickly available, organized supply of guitar picks that can easily be gripped and removed.

In one embodiment, the present invention is directed to an apparatus for storing and dispensing at least one guitar pick, comprising a first medium and second medium defined by first and second opposing edges and a third and fourth opposing edges, the first and second opposing edges forming the width therebetween, the third and forth opposing edges forming a height therebetween, the width being greater than the height, wherein the first and second mediums are joined along a portion of their opposing edges, preferably three out of the four opposing edges are joined, so that an accessible interior region is defined for storage and dispensing guitar picks. In one aspect, the apparatus of the present invention allows for the first medium or second medium or both mediums to contain a cut out, window or void therethrough, preferably rectangular in shape used for securing, housing, sliding at least one guitar pick in and out of the apparatus and/or visually identifying at least one guitar pick housed within the apparatus. In another aspect, the apparatus of the present invention is the size of a credit card, preferably between about 2 to about 5 inches in height, about 2 to about 10 inches in width and between about 0.01 inches to about 0.5 inches in thickness. In yet another aspect, the apparatus is composed of plastic or other materials that deform without rupture.

In another embodiment, the present invention is directed to an apparatus for storing and dispensing at least one guitar pick, said apparatus comprising a first medium defined by first and second opposing edges and a third and fourth opposing edges, the first and second opposing edges forming the width therebetween, the third and forth opposing edges forming a height there between, the width being greater than the height and a plurality of storage slots, preferably arch, triangular or hexagonal in shape, even more preferably arched shaped, disposed upon said first medium, wherein the slots are oriented to allow for the storage and dispensing of at least one guitar pick. In one aspect the slots frictionally retains at least one guitar pick. In another aspect, the first medium of the apparatus is flexible.

In yet another embodiment, the present invention is directed to an apparatus for storing and dispensing at least one guitar pick, comprising a first medium defined by first and second opposing edges and a third and fourth opposing edges, the first and second opposing edges forming the width therebetween, the third and forth opposing edges forming a height therebetween, the width being greater than the height, wherein the first medium further contains two cut outs, windows or voids therethrough, preferably rectangular in shape, wherein the cut outs, windows or voids are spaced or separated by a strip of the first medium of defined width and length, preferably, 0.1 centimeters to 2 centimeters in width and 0.1 centimeters and 8 centimeters in length; and a second medium defined by first and second opposing edges and a third and fourth opposing edges, the first and second opposing edges forming the width therebetween, the third and forth opposing edges forming a height therebetween, the width being greater than the height, wherein the opposing edge of the first medium and a corresponding portion of the opposing edge of the second medium are joined. In one aspect, the strip of the first medium functions to secure at least one guitar pick in place.

The apparatus and methods of the present invention has several advantages such as providing a means of holding guitar picks securely to prevent loss, holding a collection of guitar picks in a very compact space; holding guitar picks of different sizes and thickness (thin, medium and thick gauges), enabling the musician to easily grip and remove the guitar pick from the apparatus and enabling the guitar picks to be randomly selected and removed by the musician.

DETAILED DESCRIPTION OF INVENTION

The description below and drawings of the present invention focus on one or more preferred embodiments of the present invention and also describe some exemplary optional features and/or alternative embodiments. The description and drawings are for the purpose of illustration and not limitation. Those of ordinary skill in the art will recognize variations, modifications and alternatives. Such variation, modification and alternatives are also within the scope of the present invention.

FIG. 1: is a diagram depicting the apparatus for storing and dispensing guitar picks 1. The apparatus of the present invention comprises a first planar medium having two opposite longer sides or edges and two opposite shorter sides or edges, substantially rectangular in shape, as well as, an outer surface or face and an inner surface or face 2. The apparatus of the present invention further comprises a second planar medium having two opposite longer sides or edges and two opposite shorter sides or edges, substantially rectangular in shape, as well as, an outer surface or face and an inner surface or face 3. In some embodiments the opposite sides or edges are substantially linear and in some embodiments, the opposite sides or edges are curved. In some embodiments, the opposite sides or edges are parallel to each other while in some embodiments the opposite sides or edges are nearly parallel while in some embodiments the opposite sides or edges are not parallel. In some embodiments, the two opposite sides or edges define a space between the lines. The first and second planar mediums are preferably sized and shaped similar to that of a credit card. The two opposite longer sides of the first and second medium are about 1.0-12 centimeters in width, preferably about 8.5 centimeters in width and the two shorter sides of the first and second medium are about 1.0-8.0 centimeters in height, preferably about 5.5 centimeters in height. In one embodiment, the inner surface of the first and second medium are joined along a portion of their opposing edges 4. In a preferred embodiment, the two opposite longer sides or edges and one shorter side of the first and second medium are joined at the opposing edge, creating a hollow region or pocket for the storage and dispensing of guitar picks at the opposing edge that is not joined 5. The outer surface of the first and second medium further has a cut out, or void therethrough creating a window at the center of the apparatus for visualizing and for removing the guitar picks from the apparatus 6. The apparatus of the present invention includes, but is not limited to, a cloth, leather, plastic, cardboard stock, cellulose based material, metallic material or other paper material. However, the present invention is not limited to these materials and or other type of materials can also be used for the apparatus of the present invention.

In some embodiments, the cut or void therethrough is replaced by sleeve or slip that can secure a guitar pick onto the apparatus. In some embodiments the sleeve or slip is an elastic band.

Figure 2A:
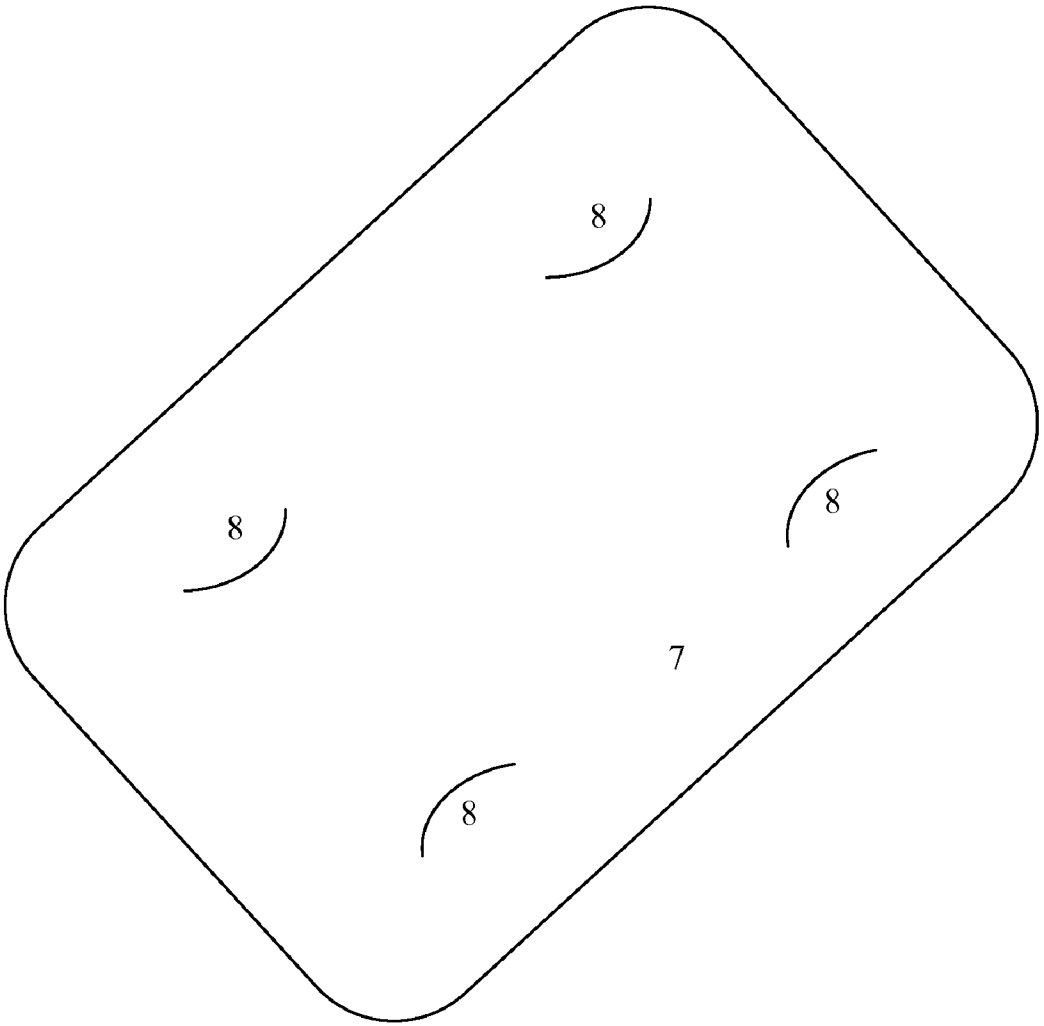
FIG. 2*a* is a perspective view of a second embodiment of the present invention.
Figure 2B:
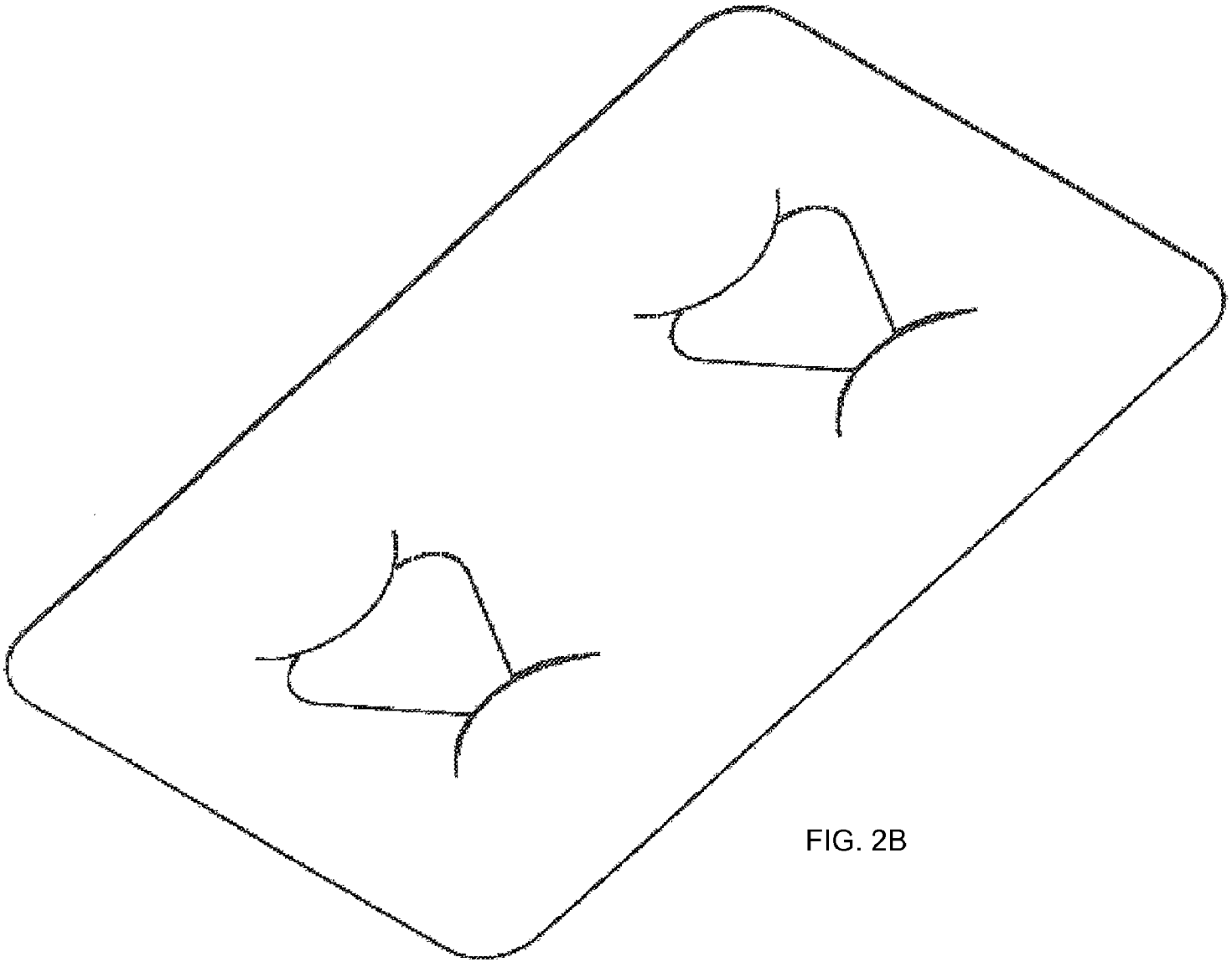
FIG. 2*b* is a front view perspective of the second embodiment of the present invention.
Figure 2C:
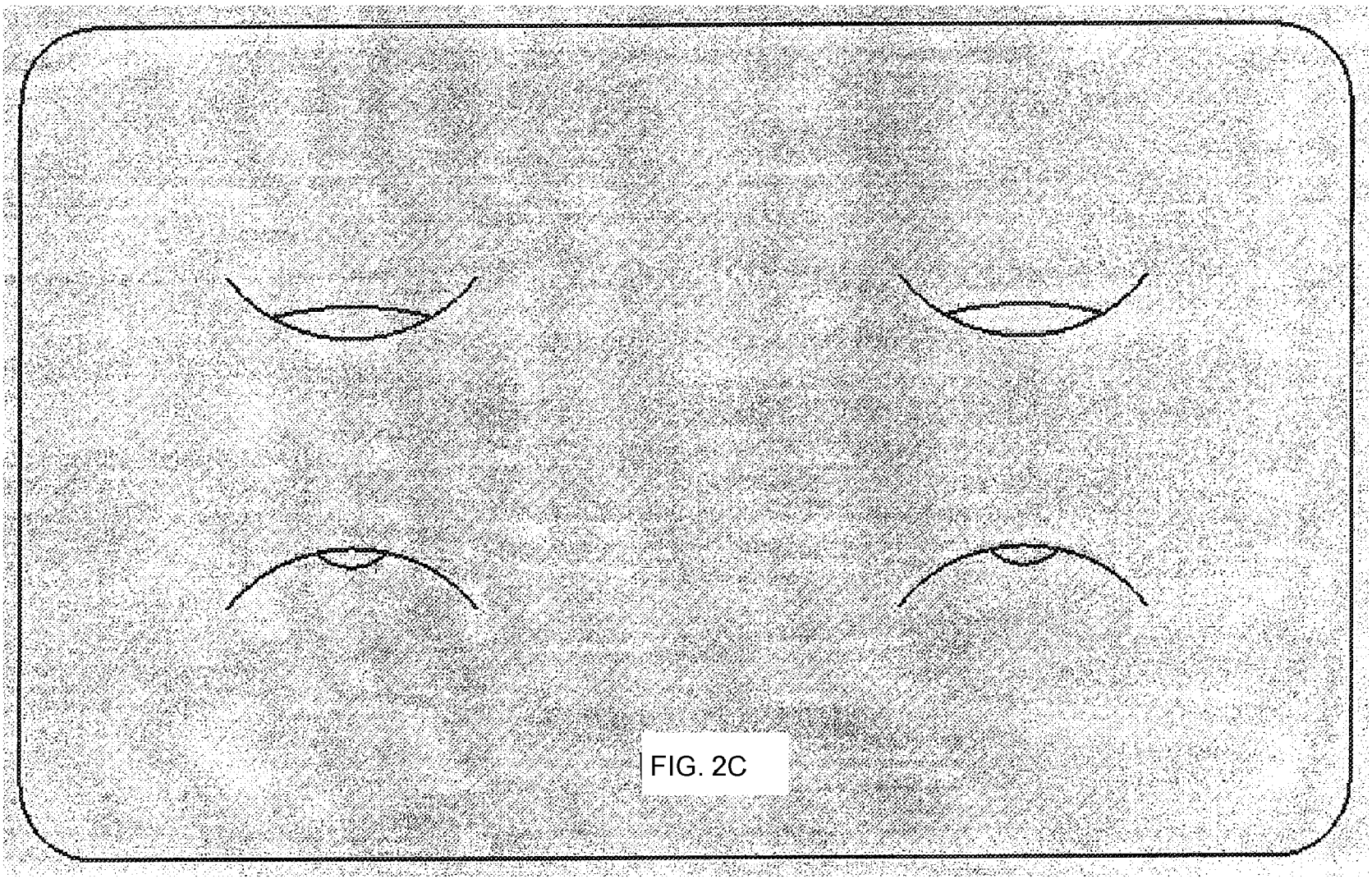
FIG. 2*c* is a back view perspective of the second embodiment of the present invention.

FIG. 2*a-c* are diagrams depicting the apparatus with a plurality of slots arranged on the front half on the planar medium for receiving guitar picks 7. The slots are positioned close together and are staggered for compactness, but still enable the picks to be easily gripped. The picks may be randomly selected and removed from any slot. Each slot can be in variety of shapes, for example, arched, triangular, or hexagonal in shape for aiding pick insertion and storage 8. The apparatus of the present invention can hold at least one guitar pick, preferably, 1-10 guitar picks, even more preferably 1-3 guitar picks.

Figure 3:
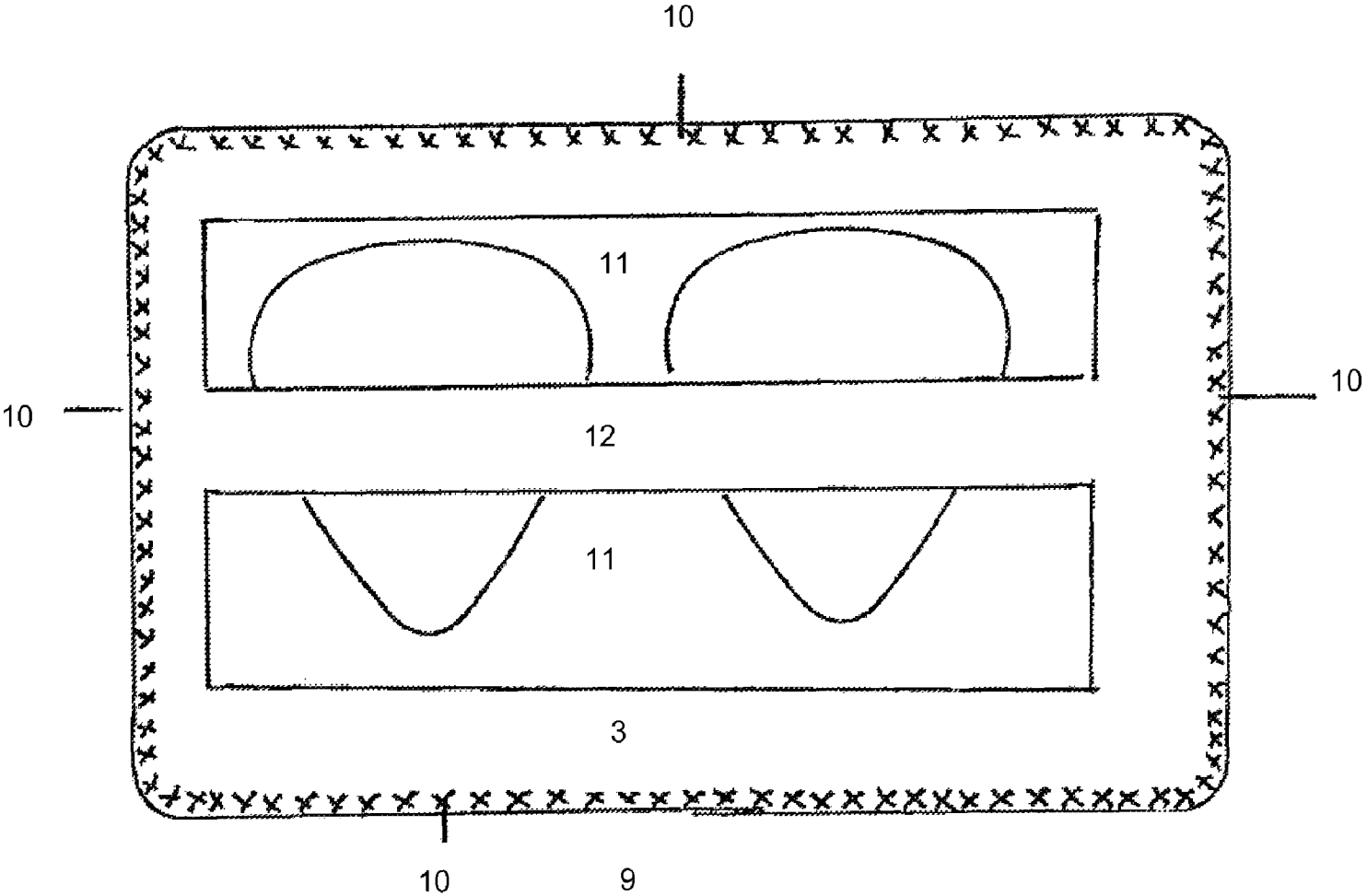
FIG. 3 is a perspective view of a third embodiment of the present invention.

FIG. 3 is a diagram depicting the apparatus of the present invention comprising a first and second planar medium having two opposite longer sides or edges and two opposite shorter sides or edges, substantially rectangular in shape, as well as, an outer surface or face and an inner surface or face 9. In one embodiment, the inner surface of the first and second medium are joined along all four sides of their opposing edges 10. The first or second planar medium of the present invention further has a plurality of cut outs or voids therethrough creating at least two windows, substantially rectangular in shape, allowing the musician to visualize the outer surface of the first or second planar medium 11. The rectangular window are separated from each other by a thin strip defined a certain width and length, preferably 0.1 centimeters to 2 centimeters in width and 0.1 centimeters and 8 centimeters in length of the first or second planar medium 12. The thin strip is used to hold and store guitar picks in place, while the apparatus is strong and flexible enough to fit in conventional wallets.

In view of the wide variety of embodiments to which the principles of the present invention can be applied, it should be understood that the illustrated embodiments are exemplary only, and should not be taken as limiting the scope of the present invention. For example, fewer or equivalent elements may be used in the block diagrams. Therefore, all embodiments that come within the scope and spirit of the following claims and equivalents thereto are claimed as the invention.

What is claimed is:

1. An apparatus for storing and dispensing guitar picks, comprising:

a first medium defined by first and second opposing edges and a third and fourth opposing edges, the first and second opposing edges forming the width therebetween, the third and forth opposing edges forming a height there between, the width being equal or greater than the height, wherein the first medium contains a cut out window therethrough sized to house at least one guitar pick; and a second medium defined by first and second opposing edges and a third and fourth opposing edges, the first and second opposing edges forming the width therebetween, the third and forth opposing edges forming a height there between, the width being equal or greater than the height;

wherein, the first and second mediums are joined along a portion of their opposing edges creating a storage space between the first and second medium for storage and/ or dispensing of one or more guitar picks wherein said apparatus is in the shape of a credit card and can be stored compactly in a wallet.

2. The apparatus of claim 1, wherein said cut out window is used for sliding guitar picks in and out of the apparatus and for visually indicating what is stored.

3. The apparatus of claim 1 or 2 wherein said cut out window is substantially rectangular.

4. The apparatus of claim 1, wherein the apparatus is between about 2 to about 5 inches in height, about 2 to about 10 inches in width and between about 0.01 inches to about 0.5 inches in thickness.

5. The apparatus of claim 1, wherein the first and second medium is composed of plastic or other material that deform without rupture.

6. An apparatus for storing and dispensing guitar picks, said apparatus comprising:

a first medium defined by first and second opposing edges and a third and fourth opposing edges, the first and second opposing edges forming the width therebetween, the third and forth opposing edges forming a height there between, the width being equal or greater than the height, and one or more storage slots disposed upon said first medium, wherein the slots are oriented in a shape to allow for the storage and dispensing of one or more guitar picks wherein said apparatus is in the shape of a credit card and can be stored compactly in a wallet.

7. The apparatus of claim 6, wherein the first medium is flexible.

8. The apparatus of claim 6, wherein the slots is arched, triangular or hexagonal in shape.

9. The apparatus of claim 6, wherein the slots frictionally retains at least one guitar pick.

10. An apparatus for storing and dispensing a guitar pick, comprising:

a first medium defined by first and second opposing edges and a third and fourth opposing edges, the first and second opposing edges forming the width therebetween, the third and forth opposing edges forming a height there between, the width being equal or greater than the height; wherein, the first medium contains two substantially rectangular cut out portion therethrough separated by a strip of the first medium for securing at least one guitar pick; and a second medium defined by first and second opposing edges and a third and fourth opposing edges, the first and second opposing edges forming the width therebetween, the third and forth opposing edges forming a height there between, the width being equal or greater than the height, wherein the opposing edges of the first and second medium are joined forming an accessible storage region on the face of the first medium for storage and/ or dispensing of guitar picks wherein said apparatus is in the shape of a credit card and can be stored compactly in a wallet.

* * * * *